United States Patent [19]

Cox

[11] Patent Number: 4,884,295

[45] Date of Patent: Dec. 5, 1989

[54] PROTECTIVE GARMENT

[76] Inventor: Mary S. Cox, Lisnavilly House, Dundalk, County Louth, Ireland

[21] Appl. No.: 270,607

[22] Filed: Nov. 14, 1988

[51] Int. Cl.[4] ..... A41D 13/00

[52] U.S. Cl. ..... 2/2; 2/2.5; 2/44

[58] Field of Search ..... 2/2, 44, 92, 2.5

[56] References Cited

U.S. PATENT DOCUMENTS

| | | | |
|---|---|---|---|
| 3,828,561 | 4/1975 | Wiwiecki | 2/2 |
| 3,945,042 | 3/1976 | Lobo | 2/2 |
| 4,694,505 | 9/1987 | Flosi et al. | 2/2 |

FOREIGN PATENT DOCUMENTS

| | | |
|---|---|---|
| 3319053 | of 1983 | Fed. Rep. of Germany . |
| 3401111 | of 1984 | Fed. Rep. of Germany . |
| 3409323 | of 1984 | Fed. Rep. of Germany . |
| 1315241 | of 1962 | France . |
| 1594526 | of 1970 | France . |

*Primary Examiner*—Ronald Feldbaum
*Attorney, Agent, or Firm*—Sughrue, Mion, Zinn, Macpeak and Seas

[57] ABSTRACT

The invention provides to a protective jacket to prevent injury to the torso of a wearer. The jacket comprises a rear panel and front panels closed by a zip fastener. The front and rear panels are formed of inner and outer sheets of material which are stitched together along seams to form a plurality of pockets. One longitudinal central pocket in the rear panel accommodates a spine protective member laminated from a poycarbonate member and impact absorbing member. Pockets adjacent the central pocket accommodate impact absorbing pads which are separated to define a waist of the jacket. Other pockets accommodate other impact absorbing pads in the rear panel and front panel.

20 Claims, 4 Drawing Sheets

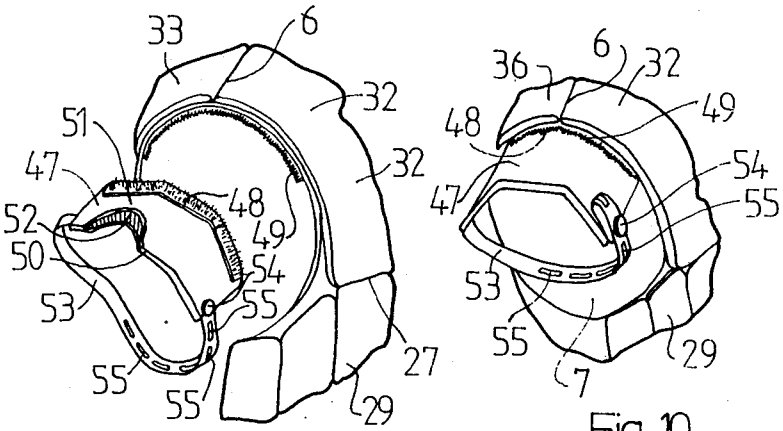
Fig. 10
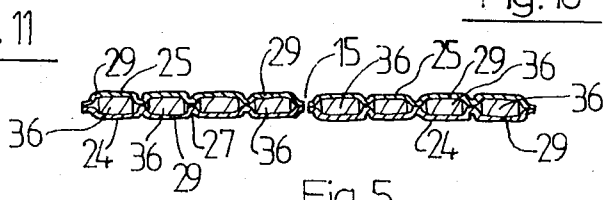
Fig. 11
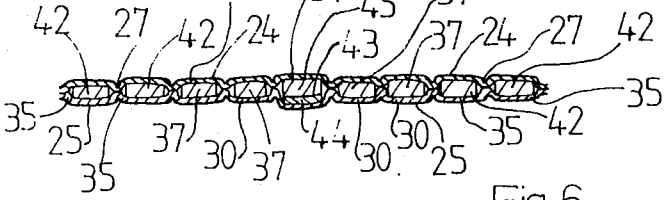
Fig. 5
Fig. 6
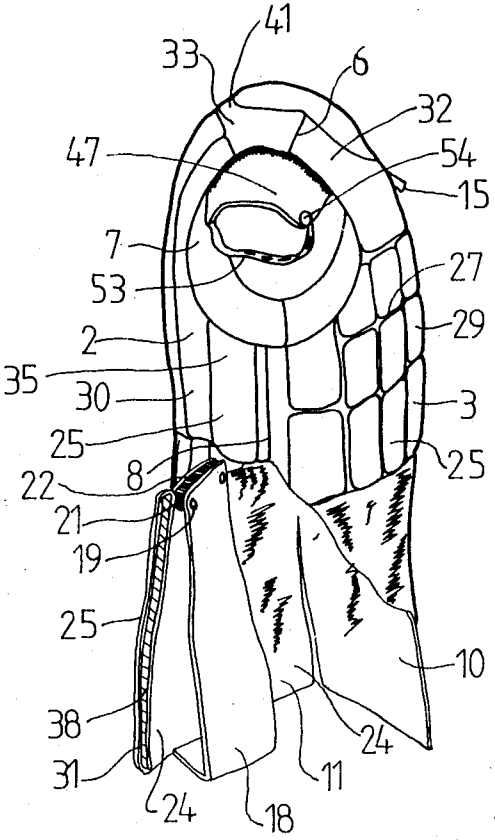
Fig. 9

PROTECTIVE GARMENT

FIELD OF THE INVENTION

The present invention relates to a protective garment, and in particular though not limited to a protective garment for protecting a wearer when engaged in sports, such as, for example, horseriding, motorcycling and the like.

BACKGROUND OF THE INVENTION

A major hazard of horseriding, motorcycling and the like is caused by the fact that it is relatively easy for a rider to fall from a horse or a motorbike. In fact, in practice, particularly in horseriding, riders, jockeys and the like are prone to a considerably large number of falls, both when riding in races, equestrian events or, indeed in practicing or training. In many cases, these falls can lead to serious injury, for example, they can lead to serious spine injuries, rib injuries, shoulder injuries, indeed, such falls can lead to injuries to any part of the body. It has been found in practice that the most serious injuries are to the torso, and particularly to the spine. These type of accidents are not restricted to horseriding and motorcycling, they can occur in many sports, such as, for example, mountain climbing, hill climbing, cycling, baseball, cricket, American football and the like.

Protective clothing is available to reduce the seriousness of injuries to the torso caused by such accidents and falls. However, known protective clothing, in general comprises jackets worn on the torso which may or may not be provided with sleeves. These jackets suffer from a number of disadvantages. In particular, known jackets which give reasonably adequate protection against accident and injury, in general, are cumbersome and considerably restrain the movement of the individual wearing them. On the other hand, jackets which give a degree of relatively free movement to the individual tend not to offer adequate protection against accidents and injury.

One typical example of the latter type of jacket is provided by the garment disclosed in U.S. Pat. Specification No. 3,945,042. This specification discloses a jacket in which resilient foamed plastic cylinders which act as impact absorbing members are provided in the garment. However, the impact absorbing members only extend over a short portion of the upper part and lower part of the back panel of the jacket. Thus, they only give limited protection to the spine of the wearer.

U.S. Pat. Specification No. 4,084,264 illustrates another type of protective garment, which in this case comprises a back panel which extends substantially over the length of the back of the wearer. A plurality of padded hoop type ribs extend around the jacket to absorb impacts, particularly from a baseball or the like. However, while this jacket does provide better protection than the jacket of U.S. Pat. Specification No. 3,945,042, it is considerably more cumbersome to use and wear. Because of the fact that the hoop type ribs extend over the length of the back of the wearer, the ability of the wearer to bend is restricted. Attempts to overcome this are made by cutting away portion of the front panels of the jacket, however, these provide available to the individual. Furthermore, by virtue of the fact that portions of the front panels are cut away, protection is reduced.

U.S. Pat. Specification No. 3,514,786 illustrates another type of protective garment. This U.S. Pat. specification discloses a garment having front and rear panels. Reinforcing pads are provided mounted in the panels, however, the panels only give limited protection to the individual, and do not adequately protect the spine of the individual. U.S. Pat. Specification No. 3,500,472 illustrates another type of protective garment which is provided by a panel which is strapped around the individual. A plurality of cushioning units are attached to the garment, each of which comprise a relatively rigid member covered with spongy material shaped to conform with the shape of the body. However, this garment essentially only protects the upper part of the back and consequently does not offer adequate protection to the spine.

There is therefore a need for a protective garment which overcomes the problems of known garments.

OBJECTS OF THE INVENTION

One object of the invention is to provide a protective garment which provides reasonably adequate protection to an individual in the event of a fall or a accident during sporting activities, for example, a fall from a horse or motorcycle, or injuries resulting from accidents during mountain climbing, playing baseball, cricket, American football and the like. Another object of the invention is to provide such a jacket which provides adequate protection, while at the same time permitting the individual a reasonable degree of movement while wearing the jacket. In particular it is an object of the invention to provide a jacket which enables the wearer to bend forwardly or backwardly or sidewardly. It is also an object of the invention to provide a protective garment which provides freedom of movement of the arms. A particular object of the invention is to provide a protective garment which protects the spine. Another object of the invention is to provide a protective garment which protects the wearer against injuries caused by sudden impact, by falling on the ground, being struck by a ball or the like.

SUMMARY OF THE INVENTION

According to the invention there is provided a protective garment for protecting the torso, the garment comprising a rear panel having an upper and a lower portion defining a waist therebetween, an elongated spine protective member extending longitudinally of the rear panel from the upper portion to the lower portion across the waist to in use co-incide with at least portion of the spine of the wearer, at least one main elongated impact absorbing member extending longitudinally of the rear panel on each side of the spine protective member, each main impact absorbing member comprising an upper and a lower elongated impact absorbing pad which define therebetween portion of the waist.

In one embodiment of the invention, the upper and lower impact absorbing pads are spaced apart from each other.

In another embodiment of the invention, the spine protective member extends, in use, from a position just below a neck portion of the rear panel to the bottom of the lower portion of the rear panel to, in use, co-incide with the coccyx of the spine.

In another embodiment of the invention, two main impact absorbing members are provided on each side of the spine protective member.

Advantageously, a plurality of elongated secondary impact absorbing pads are provided in the upper portion of the rear panel between the main impact absorbing members and the side of the rear panel.

Preferably, the spine protective member is a composite member comprising an elongated reinforcing member laminated to an elongated member of impact absorbing material.

In a further embodiment of the invention, an impact absorbing shoulder pad is provided adjacent a neck portion of the rear panel, the shoulder pad extending from one side of the rear panel to the other across the top of the spine protective member.

In another embodiment of the invention, a front panel is provided, the front panel having an upper portion and a lower portion defining a waist therebetween, the front panel being joined to the rear panel at each side thereof along a seam extending from beneath an arm opening to the waist, a plurality of impact absorbing pads being provided in the upper portion of the front panel. Preferably, the front panel is formed by a pair of panels releasably joined together by releasable fastening means extending longitudinally of the front panel. Advantageously, some of the impact absorbing pads in the front panel are of rectangular shape. Preferably, an impact absorbing pad is provided in each panel of the front panel, each impact absorbing pad extending downwardly from the top of the panel towards the breastbone of the wearer, in use.

In another embodiment of the invention, a plurality of discrete pockets are provided in the front and rear panels for accommodating the spine protective member and respective impact absorbing pads. Advantageously, the front and rear panels are each formed by an inner and an outer sheet of material secured together to form the pockets therebetween. Preferably, the inner sheet of each panel is of light nylon material and the outer sheet is of rib stop nylon.

In another embodiment of the invention, each impact absorbing pad is of closed cell expanded polyethylene.

In another embodiment of the invention, a crotch member extends from the rear panel to the front panel, the crotch member being releasably connected by releasable fastening means to one or other panel. Preferably, releasable fastening means are provided to releasably fasten the crotch member to the panel from which it extends when not in use.

In a further embodiment of the invention, releasable outer shoulder pads of impact absorbing material are provided, releasable fastening means being provided to secure the outer shoulder pads to the front and rear panels. Preferably, a strap member extends from one side of each outer shoulder pad to the other to extend, in use, beneath the arm of the wearer.

In another embodiment of the invention, the garment is in the form of a sleeveless jacket.

ADVANTAGES OF THE INVENTION

The advantages of the invention are many. A particularly important advantage of the invention is that the protective garment according to the invention offers a relatively high degree of protection to the spine of the wearer. The garment according to the invention also provides protection to the wearer against most injuries, and in particular relatively serious injuries resulting from a sudden impact, for example an impact caused by an individual falling or being struck by a ball. Where the garment is provided with impact absorbing pads in the front and back panels, particularly good protection against impact is provided. By virtue of the fact that the spine protective member extends over a substantial portion of the back and in particular across the waist of the wearer which in many case is particularly prone to injury, good protection of the spine is offered by the garment. Further, by virtue of the fact that the main impact absorbing members are provided by upper and lower impact absorbing pads which define portion of the waist of the garment, the wearer is afforded considerable freedom of movement while wearing the jacket and still benefiting from the relatively good protective characteristics of the jacket.

Where the spine protective member is provided by polycarbonate material, a jacket with good protective properties and also a garment which provides relatively good freedom of movement is provided. Polycarbonate material is a relatively flexible material while at the same time a particularly strong material. Thus, the polycarbonate bends with the spine to accommodate normal bending during normal movement of the spine and the back, however, on being subject to impact or a fall, the polycarbonate is sufficiently strong and rigid to protect the individuals spine. Where the spine protective member is provided by a laminate of polycarbonate and an impact absorbing material, further improvement is achieved in the protection offered to the wearer and in particular the protection offered to the spine of the wearer. Furthermore, the impact absorbing material laminated to polycarbonate material assists in absorbing the impact in the event of a fall, thereby reducing the amount of force to which the body is subjected to any such impacts.

A further advantage of the invention is achieved by virtue of the fact that the impact absorbing pads and the spine protective member are provided in discrete pockets. This thus retains all pads and members in their correct relative position. Furthermore, by providing the impact absorbing material in a plurality of pads further enhances the impact absorbing characteristics of the garment as well as enhancing the degree of freedom of movement offered to the individual wearing the garment.

A further advantage of the invention is that the jacket according to the invention is a relatively low cost jacket and can be produced relatively easily and efficiently. This is particularly achieved by virtue of the construction of the jacket.

These and other objects of the invention will be readily apparent from the following description of a preferred embodiment thereof, given by way of example only, with reference to the accompanying drawings.

BRIEF DESCRIPTION OF THE DRAWINGS

FIG. 5 is a sectional view of portion of the garment of FIG. 1 on the line V—V of FIG. 2, FIG. 6 is a sectional view of portion of the garment of FIG. 1 on the line VI—VI of FIG. 3, FIG. 9 is a partly cut-away perspective view of the garment of FIG. 1, FIG. 10 is a perspective view of another detail of the garment of FIG. 1, and FIG. 11 is a perspective view of the detail of FIG. 10.

DETAILED DESCRIPTION OF THE INVENTION

Figure 1:
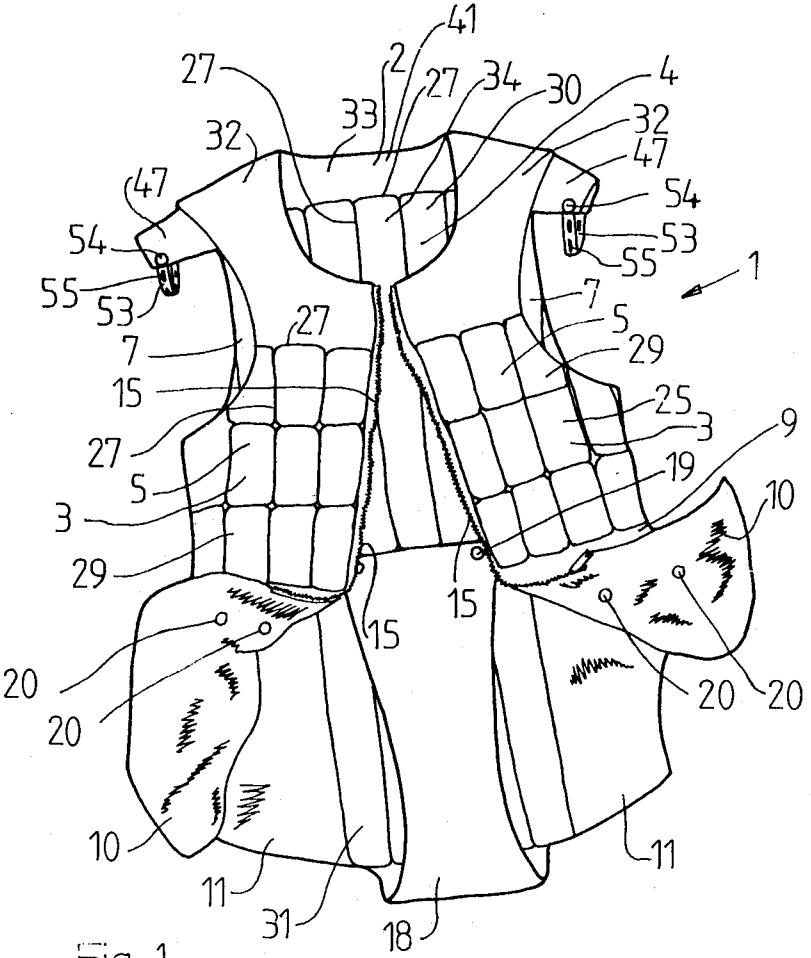
FIG. 1 is a perspective view of a protective garment according to the invention.
Figure 4:
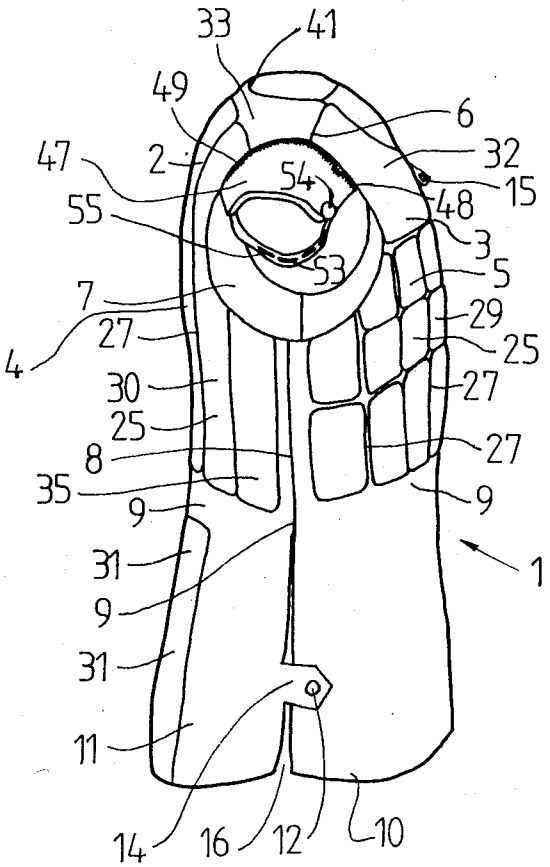
FIG. 4 is a side view of the garment of FIG. 1.
Figure 3:
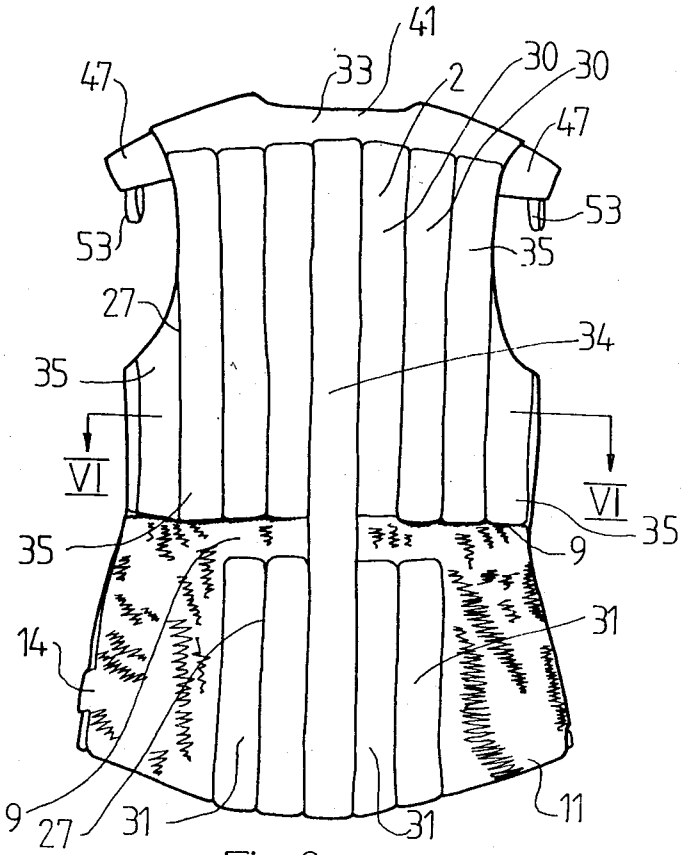
FIG. 3 is a rear view of the garment of FIG. 1.
Figure 2:
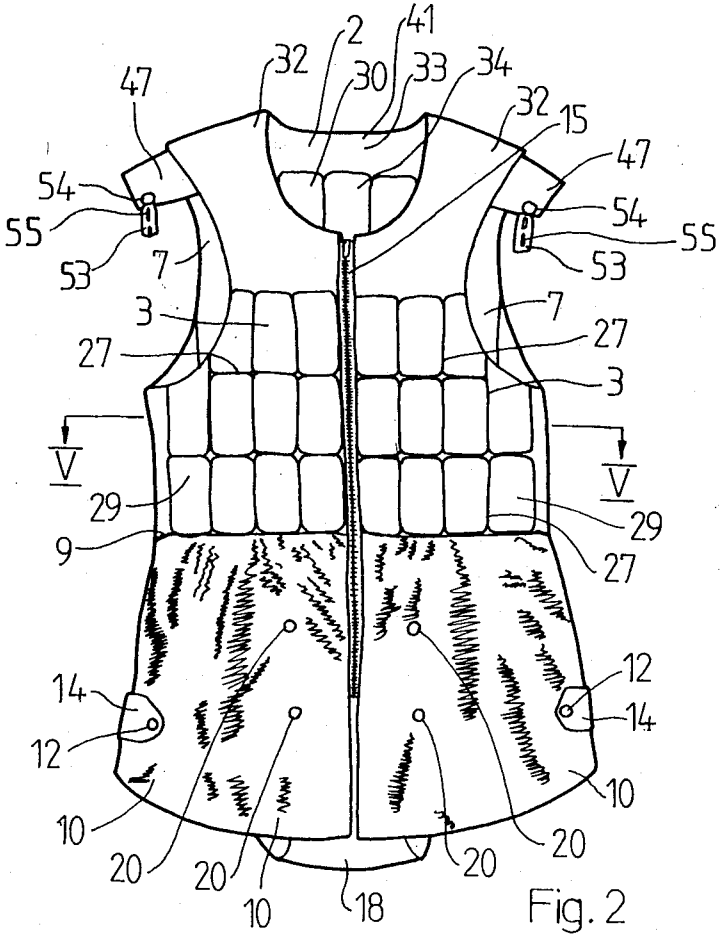
FIG. 2 is a front view of the garment of FIG. 1.
Figure 8:
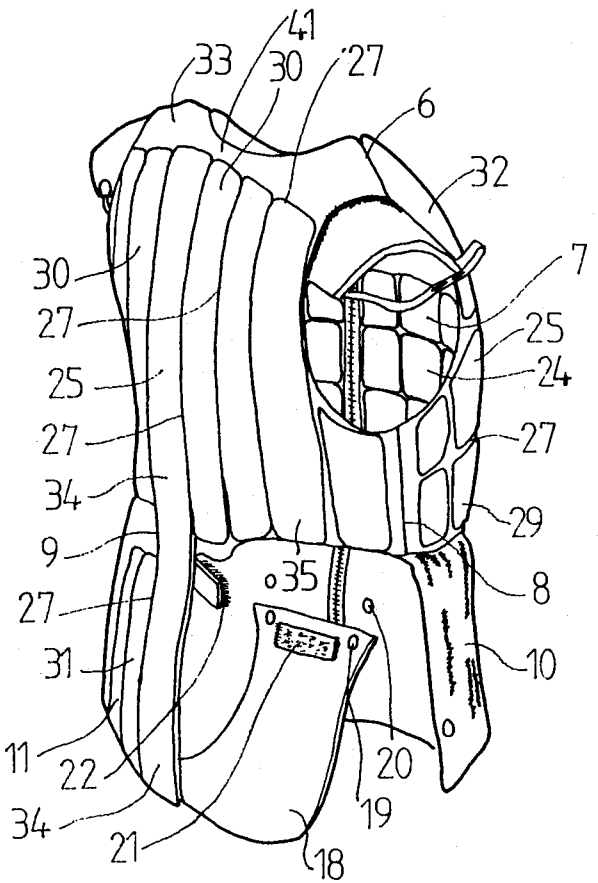
FIG. 8 is a partly-cut away perspective view of the garment of FIG. 1.
Figure 7:
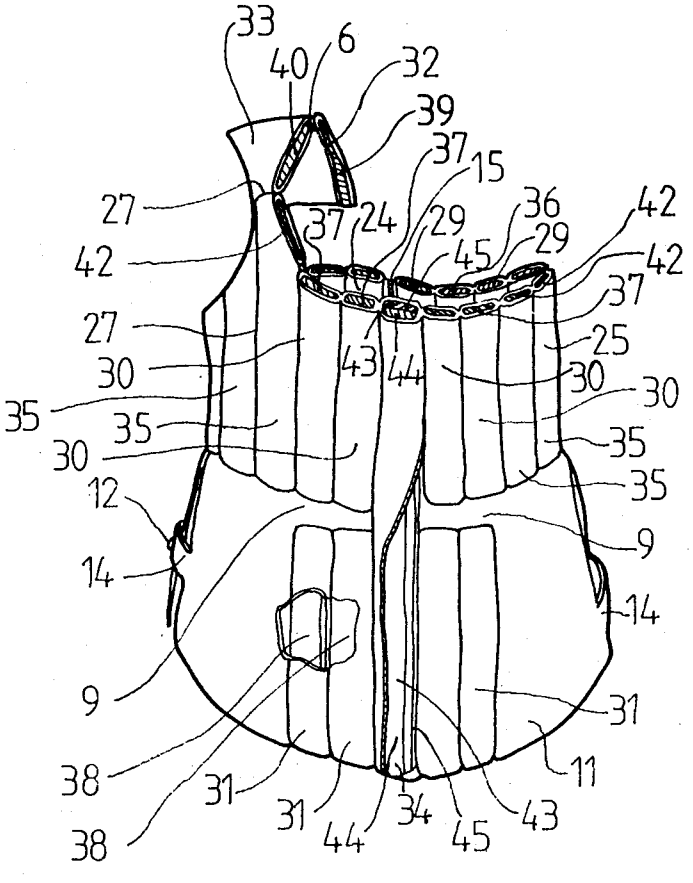
FIG. 7 is a partly cut-away perspective view of the garment of FIG. 1.

Referring to the drawings, there is provided a protective garment according to the invention, in this case the garment is in the form of a sleeveless jacket indicated generally by the reference numeral 1. The jacket 1 comprises a rear panel 2 having an upper portion 4 and a lower portion 11, and a pair of front panels 3, each having an upper portion 5 and a lower portion 10. The upper and lower portions 4 and 5 and 10 and 11 respectively define a waist 9 of the jacket 1. Openings 7 accommodate the arms of the wearer. The front panels 3 are joined to the rear panels 2 by seams 8 which extend below the arm opening 7 to the waist 9. Seams 6 join the top of the front panels 3 to the rear panel 2. Vents 16 are formed between lower portions 10 and 11 of the front and rear panels 3 and 2 respectively. Releasable fastening means provided by stud fasteners 12 on a pair of flaps 14 extending from the lower portions 11 of the rear panel 2 secure the lower portions 10 and 11 together. A releasable fastening means, in this case a zip fastener 15 joins the two front panels 3 together. A crotch member 18 extending from the lower portion 11 of the rear panel 2 is releasably connected to the lower portions 10 of the front panels 3 by stud fasteners 19. Two pairs of corresponding stud fasteners 20 on the lower portion 10 of the front panels 3 engage the fasteners 19 to provide adjustment of the crotch member 18. When it is desired to use the jacket without the crotch member extending beneath the wearers crotch, the crotch member 18 may be secured to the rear panel 2, as illustrated in FIG. 9, by strips of hooks and eyes 21 and 22 on the crotch member 18 and rear panel 2 respectively. Such strips of hooks and eyes are sold under the Trade Mark VELCRO.

The front and rear panels 2 and 3 are constructed of two sheets of material, namely an inner sheet 24 and an outer sheet 25. The inner sheet 24 is of a relatively light woven nylon material, for example, a lining material. The outer sheet 25 is of a rib stop nylon. The inner and outer sheets 24 and 25 are joined together along a plurality of seams 27 which form a plurality of pockets, namely front pockets 29, upper rear pockets 30, lower rear pockets 31, side rear pockets 35, top pockets 32, a shoulder pocket 33 and a central pocket 34. The pockets 29 to 33 and 35 accommodate pads 36 to 40 and 42 respectively of impact absorbing material, in this case closed cell expanded polyethelene material to prevent injury to the body of the wearer. The pads 36 to 40 and 42 are described in more detail below.

The central pocket 34 extends from just below a neck portion 41 of the rear panel 2, through the waist 9 to the bottom of the lower portion 11 and accommodates a spine protective 43. The spine protective member 43 is a composite member formed from an elongated reinforcing member 44, which is laminated to an elongated member 45 of impact absorbing material.

In this case the reinforcing member 44 is of polycarbonate material and the impact absorbing member 45 is of closed cell polyethelene material similar to the pads 36 to 40 and 42. The overall width of the spine protective member 43 is approximately 4 centimeters. The thickness of the member 43 is approximately 1 centimeter. The thickness of the polycarbonate reinforcing member 44 is approximately 0.1 centimeters. It has been found that by forming the reinforcing member 44 from a strip of polycarbonate material of 0.1 centimeters in thickness by 4 centimeters in width, the spine protective member is sufficiently rigid to protect the spine in use, while at the same time providing a sufficient degree of flexibility to permit the spine protective member 43 to substantially assume the shape of the contour of the wearer's spine and bend with the bearer. This has the great advantage that it facilitates ease of movement of the wearer when wearing the jacket, while at the same time, offering substantial protection to the spine in the event of a fall or the like. Indeed, polycarbonate material is also sufficiently resistant to impact and shock that it does not fracture or break easily, thereby offering substantial protection to the spine. Needless to say, while the reinforcing member has been described as being of polycarbonate material, it could be of any other suitable material which is sufficiently rigid and impact resistant to protect the wearer's spine in the event of a fall, while at the same time being sufficiently flexible to permit the spine protective member to assume substantially the contour of the wearer spine in use.

Referring now to the pockets 29 to 33 and 35 and the impact absorbing pads 36 to 40 and 42, two upper rear pockets 30 and two lower rear pockets 31 are provided on each side of the spine protective member 43 to accommodate main impact absorbing members formed by upper and lower impact absorbing pads 37 and 38. As can be seen, the pockets 30 and 31 and in turn the upper and lower impact absorbing pads 37 and 38 are spaced apart to define the waist 9 of the jacket 1. The pockets 35 in the upper portion of the rear panel 2 accommodate secondary impact absorbing provided by the pads 42. The shoulder pockets 33 in the rear panel 2 accommodates a shoulder impact absorbing pad 40 which extends from one side of the rear panel 2 to the other side across the top of the spine protective member 43. This pad 40 protects the shoulders and shoulder blades of the wearer. The front pockets 29 in the front panels 3 accommodate the impact absorbing pads 36 which as can be seen are of substantially rectangular shape. The top pockets 32 in the front panels 3 accommodate the impact absorbing pads 39 and as can be seen these pads 39 extend downwardly from the top of the front panels 3 to a position just above the breastbone of the wearer, thus protecting the upper front portion of the torso from impact.

By virtue of the fact that the upper and lower main impact absorbing pads 37 and 38 are separated to define portion of the waist 9 and the fact that the secondary impact absorbing pads 42 and front pads 36 terminate at the waist 9 of the jacket, a jacket which allows a high degree of freedom of movement to the wearer is provided.

It has been found that by forming the impact absorbing pads 36 to 40 ad 42 from closed cell expanded polyethelene material, a particularly good impact absorbing jacket is provided. The closed cell expanded polyethelene material is of sufficient resilience to absorb most impacts to which the body is subjected to as a result of falling or being struck by a ball or other hard object. In fact, it has been found that the use of closed cell expanded polyethelene material avoids most bruising of the body, and in most cases also prevents bone fractures and breakages. The closed cell expanded polyethelene material is sufficiently lightweight to provide a relatively lightweight jacket. This needless to say further facilitates ease of movement for the wearer when wearing the jacket and furthermore, avoids the wearer becoming fatigued as a result of wearing the jacket, which has been a problem of jackets known heretofore.

Shoulder pads 47 to protect the outer portion of the shoulders of the wearer are releasably connected to the front and rear panels 3 and 2 by strips of hooks and eye material 48 and 49 respectively, namely VELCRO material on the pads 47 and front and rear panels 3 and 2. The shoulder pads 47 are formed from an inner and outer sheet of material 50 and 51 similar to the inner and outer sheets 24 and 25, and the sheets 50 and 51 form one single pocket to house pads 52 of impact absorbent material, namely closed cell expanded polyethelene material. Straps 53 extending from one edge to the other of the shoulder pads 47 extend, in use, under the arm of the wearer to retain the shoulder pads 47 in position. A button 54 and a plurality of button holes 55 are provided on the straps 53 to facilitate adjusting of the length of the strap 53.

In use, the wearer puts on the jacket in conventional manner. Where it is desired to use the crotch member 18, the crotch member 18 is secured by the stud fasteners 15 to the studs 20 in the front panels 3. If it is desired not to use the crotch member 18 it is secured to the back panel 2 by the strips of hooks and eyes 21 and 22. The zip fastener 15 is closed and if desired, the vents 16 are closed by the flaps 14 and fasteners 12. If it is desired to wear the jacket 1 without the shoulder pads 47, these are merely detached by releasing the strips of hooks and eyes 48 and 49.

The invention has many advantages. By virtue of the fact that the pads 36 to 40 and 42 of impact absorbing material are of closed cell expanded polyethelene material a jacket which provides considerable protection against injury as a result of a fall is provided, while at the same time the jacket is of relatively lightweight. This is because the closed cell expanded polyethelene material is a relatively lightweight material, while at the same time having relatively high impact absorbing characteristics and is also of relatively high impact strength.

Furthermore, by virtue of the fact that the panels are arranged as illustrated, considerable amount of freedom of movement is provided to the wearer. Furthermore, by virtue of the fact that the jacket is provided with a plurality of pockets, this further facilitates ease of movement when wearing the jacket. Indeed, it has been found that by having the upper and lower rear pockets and their impact absorbing pads spaced apart and defining the waist of the jacket further contributes to freedom of movement of the wearer.

A particular advantage of the invention is achieved by virtue of the fact that a spine protective member is provided. This offers considerable protection to the wearers spine in the event of a fall. As can be seen, the spine protective member extends through the rear panel from just below the neck to the bottom of the lower panel 11. The lower portion, in general, when in use coincides with the coccyx of the spine. Accordingly, protection is offered over substantially the length of the spine. By virtue of the fact that the spine protective member is provided by a composite laminated member further advantages are achieved in that the closed cell expanded polyethelene members acts to absorb any impacts as a result of a fall, while a member of polycarbonate material prevents distortion of the spine as a result of impact. In the normal course of events, it is envisaged that the jacket will be provided with the polycarbonate member 44 on the outer side, while the impact absorbing member 45 will be on the inner side, substantially adjacent the spine, in use, although these positions may be reversed. Indeed, the use of polycarbonate material as the reinforcing member provides a further considerable advantage in that the polycarbonate material while being of relatively high strength is also a relatively lightweight material and therefore facilitates in providing a relatively lightweight jacket.

It will be appreciated that while the protective garment in this particular embodiment of the invention has been described as being of jacket construction, it could be of any other construction or shape. For example, in certain cases, it is envisaged that it may be provided in the form of a type of jumper, whereby it would be pulled over the head, in use. In such a case, it is envisaged that the protective garment would be provided with a single front and a single rear panel. Needless to say, it will be appreciated that side vents in the lower portions of the front and rear panels need not be provided.

It will, of course, be appreciated that if desired the garment may be provided with sleeves which may or may not be provided with impact absorbing material.

It will of course be appreciated that if desired, shoulder pads may be dispensed with without departing from the scope of the invention, and where shoulder pads are provided, they may be secured permanently, or secured by any other releasable means.

Further, it is envisaged that fastening means other than zip fasteners could be used for securing the front panel. Furthermore, fastening means besides stud fasteners and VELCRO could be provided.

It will also of course be appreciated that the front and rear panels could be formed in any other shape and construction and joined by seams in any other suitable locations. In certain cases, the front panel or panels may be provided without impact absorbing material, and in certain cases the front panel or panels may be dispensed with. It will of course be appreciated that if desired, the crotch member may be dispensed with, without departing from the scope of the invention. In certain cases, it is envisaged that the crotch member may be provided permanently secured to the front and rear members. Needless to say, where the crotch member is provided any other suitable form of releasable means may be provided besides stud fasteners for securing the crotch member.

It will be appreciated that while the impact absorbing material has been described as being closed cell expanded polyethelene material, any other suitable impact absorbing material could be used. However, it is preferable that whatever impact absorbing material is used, it should be a lightweight material. It will also be appreciated that a spine protective member other than a composite member could be provided. Indeed, in certain cases it is envisaged that the spine protective member may be provided by a single member of one material. The spine protective member may comprise a reinforcing member or otherwise. Similarly, it may or may not be of impact absorbing material. Any other suitable reinforcing material besides polycarbonate could be used without departing from the scope of the invention, as indeed could any other impact absorbing material be used. In fact, the spine protective member may be laminated from a number of layers of material, for example, a layer of reinforcing material sandwiched between a pair of layers of impact absorbing material.

Further, it will be appreciated that front pockets of shape and/or size other than those described could be used without departing from the scope of the invention, as indeed could other pockets 32 be provided. Indeed, in certain cases it is envisaged that the pockets 32 could be provided by a plurality of individual pockets, and in certain cases, it is envisaged that the front pockets, instead of being provided by one large pocket. Indeed, in certain cases, each front panel 3 could be provided comprising one single large pocket only which would accommodate the top impact absorbing pad 39 and the pads 36 which may or may not be provided as one large single pad.

It will, of course, be appreciated that a shoulder pocket of any other shape and construction could be provided. In certain cases, it is envisaged that the shoulder pocket may extend further down the back, and in other cases, it is envisaged that it may be provided by two pockets which would be intersected by the central pocket 34. Further, any other shape, size or construction of rear pockets 30 and 31 could be provided. In certain cases, it is envisaged that the central pocket may be provided by a number of separate pockets.

While the pockets have been described as being formed by stitching the inner and outer sheets of material together, they could be formed by any other suitable means. For example, in certain cases, the materials of the inner and outer sheets may be suitable for heat welding, and in which case, the pockets could be formed by heat welding the inner and outer sheets together. In other cases, it is envisaged that the pockets may be totally sealed, while in other cases it is envisaged that portion of the pockets may be left open to enable the insertion or withdrawal of the pads therefrom.

Indeed, it will be appreciated that the pockets could be formed by any other means besides being formed by an inner and outer sheet joined together. For example, in certain cases it is envisaged that each panel may be provided by a single sheet of material and pockets could be stitched or secured in any other suitable way onto each single sheet. It is also envisaged that the impact absorbing material and/or the spine protective member could be secured to the respective panels by means other than pockets without departing from the scope of the invention.

It is also envisaged that inner and outer sheets besides sheets of nylon material could be used without departing from the scope of the invention.

It is also envisaged, in certain cases, that the spine protective member may be pre-shaped to substantially the shape of the curvature of the spine.

It will be appreciated that spine protective members of other widths and thicknesses besides those described may be provided. However, it is envisaged that in most cases it would not exceed 15 centimeters in width and preferably would not exceed 10 centimeters in width.

Furthermore, although the upper and lower rear pockets have been described as being spaced apart to define a waist, where the upper and lower rear pockets are formed separately it is not necessary that they should be spaced apart they may abut each other at the waist.

I claim:

1. A protective garment for protecting the torso, the garment comprising;

a rear panel having an upper and a lower portion defining a waist therebetween, an elongated spine protective member extending longitudinally of the rear panel from the upper portion to the lower portion across the waist to in use coincide with at least portion of the spine of the wearer, at least one main elongated impact absorbing member extending longitudinally of the rear panel on each side of the spine protective member, each main impact absorbing member comprising an upper and a lower elongated impact absorbing pad which define therebetween portion of the waist.

2. A protective garment as claimed in claim 1 in which the upper and lower impact absorbing pads are spaced apart from each other.

3. A protective garment as claimed in claim 1 in which the spine protective member extends, in use, from a position just below a neck portion of the rear panel to the bottom of the lower portion of the rear panel to, in use, co-incide with the coccyx of the spine.

4. A protective garment as claimed in claim 1 in which two main impact absorbing members are provided on each side of the spine protective member.

5. A protective garment as claimed in claim 1 in which a plurality of elongated secondary impact absorbing pads are provided in the upper portion of the rear panel between the main impact absorbing members and the side of the rear panel.

6. A protective garment as claimed in claim 1 in which the spine protective member is a composite member comprising an elongated reinforcing member laminated to an elongated member of impact absorbing material.

7. A protective garment as claimed in claim 1 in which an impact absorbing shoulder pad is provided adjacent a neck portion of the rear panel, the shoulder pad extending from one side of the rear panel to the other across the top of the spine protective member.

8. A protective garment as claimed in claim 1 in which a front panel is provided, the front panel having an upper portion and a lower portion defining a waist therebetween, the front panel being joined to the rear panel at each side thereof along a seam extending from beneath an arm opening to the waist, plurality of impact absorbing pads being provided in the upper portion of the front panel.

9. A protective garment as claimed in claim 8 in which the front panel is formed by a pair of panels releasably joined together by releasable fastening means extending longitudinally of the front panel.

10. A protective garment as claimed in claim 8 in which some of the impact absorbing pads in the front panel are of rectangular shape.

11. A protective garment as claimed in claim 9 in which an impact absorbing pad is provided in each panel of the front panel, each impact absorbing pad extending downwardly from the top of the panel towards the breastbone of the wearer, in use.

12. A protective garment as claimed in claim 8 in which a plurality of discrete pockets are provided in the front and rear panels for accommodating the spine protective member and respective impact absorbing pads.

13. A protective garment as claimed in claim 12 in which the front and rear panels are each formed by an inner and an outer sheet of material secured together to form the pockets therebetween.

14. A protective garment as claimed in claim 10 in which the inner sheet of each panel is of light nylon material and the outer sheet is of rib stop nylon.

15. A protective garment as claimed in claim 1 in which each impact absorbing pad is of closed cell expanded polyethylene.

16. A protective garment as claimed in claim 8 in which a crotch member extends from the rear panel to the front panel, the crotch member being releasably connected by releasable fastening means to one or other panel.

17. A protective garment as claimed in claim 16 in which releasable fastening means are provided to releasably fasten the crotch member to the panel from which it extends when not in use.

18. A protective garment as claimed in claim 8 in which releasable outer shoulder pads of impact absorbing material are provided, releasable fastening means being provided to secure the outer shoulder pads to the front and rear panels.

19. A protective garment as claimed in claim 18 in which a strap member extends from one side of each outer shoulder pad to the other to extend, in use, beneath the arm of the wearer.

20. A protective garment as claimed in claim 1 in which the garment is in the form of a sleeveless jacket.

* * * * *